US007051762B2

(12) United States Patent
Haamer

(10) Patent No.: US 7,051,762 B2
(45) Date of Patent: May 30, 2006

(54) ONE-WAY VALVE

(75) Inventor: Joel Haamer, Nösund (SE)

(73) Assignee: Micvac AB, Göteborg (SE)

( * ) Notice: Subject to any disclaimer, the term of this patent is extended or adjusted under 35 U.S.C. 154(b) by 0 days.

(21) Appl. No.: 10/474,921

(22) PCT Filed: Apr. 29, 2002

(86) PCT No.: PCT/SE02/00830

§ 371 (c)(1),
(2), (4) Date: Nov. 7, 2003

(87) PCT Pub. No.: WO02/087993

PCT Pub. Date: Nov. 7, 2002

(65) Prior Publication Data

US 2006/0076069 A1 Apr. 13, 2006

(30) Foreign Application Priority Data

Apr. 30, 2001 (SE) ..... 0101516
May 30, 2001 (SE) ..... 0101881

(51) Int. Cl.
*F16K 37/00* (2006.01)
*B65D 33/01* (2006.01)
*B65D 81/34* (2006.01)

(52) U.S. Cl. ..... 137/855; 137/557; 383/103; 426/118

(58) Field of Classification Search ..... 137/843, 137/859, 855; 383/103; 220/89.1; 426/118
See application file for complete search history.

(56) References Cited

U.S. PATENT DOCUMENTS

| | | | | | |
|---|---|---|---|---|---|
| 4,000,846 | A | * | 1/1977 | Gilbert | 383/103 |
| 4,206,870 | A | * | 6/1980 | DeVries | 383/103 |
| 4,574,174 | A | | 3/1986 | McGonigle | |
| 4,653,661 | A | * | 3/1987 | Buchner et al. | 220/203.16 |
| 5,263,777 | A | * | 11/1993 | Domke | 383/103 |
| 5,428,209 | A | | 6/1995 | Babu et al. | |
| 5,584,409 | A | * | 12/1996 | Chemberlen | 220/89.1 |
| 5,727,881 | A | * | 3/1998 | Domke | 383/103 |
| 5,780,824 | A | | 7/1998 | Matos | |
| 5,782,266 | A | * | 7/1998 | Domke | 137/551 |
| 5,881,881 | A | * | 3/1999 | Carrington | 206/524.8 |
| 5,989,608 | A | * | 11/1999 | Mizuno | 426/113 |
| 2001/0012530 | A1 | * | 8/2001 | Hiyoshi | 426/118 |

FOREIGN PATENT DOCUMENTS

| | | | |
|---|---|---|---|
| EP | 0 023 703 | * | 2/1981 |
| EP | 0288862 | A1 | 11/1988 |
| JP | 11-49251 | * | 2/1999 |
| JP | 11-147559 | A | 6/1999 |
| JP | 2000-25849 | A * | 1/2000 |
| JP | 2000-191054 | A | 7/2000 |

* cited by examiner

*Primary Examiner*—Ramesh Krishnamurthy
(74) *Attorney, Agent, or Firm*—Birch, Stewart, Kolasch & Birch, LLP

(57) ABSTRACT

A one-way valve, intended particularly for use in food packages The valve, which is intended to be fitted on a package, is arranged to open in response to an excess pressure inside and is recloseable. An adhesive sheet is arranged on top of an aperture formed in the packaging material. The adhesive sheet being arranged to uncover the aperture when exposed to pressure loads.

15 Claims, 5 Drawing Sheets

ONE-WAY VALVE

This application is the national phase under 35 U.S.C. § 371 of PCT International Application No. PCT/SE02/00830 which has an International filing date of Apr. 29, 2002, which designated the United States of America.

TECHNICAL FIELD OF INVENTION

The present invention relates to a one-way valve particularly intended for food packages, said valve designed to be fitted on a package and arranged to open in response to excess pressure inside said package. The one-way valve is recloseable.

TECHNICAL BACKGROUND OF INVENTION

One-way valves of the kind defined in the introduction are previously known. The Fres-co System from the Goglio Group and the Wicovalve® from Wipf are examples of valves of this kind that comprise a button-shaped cylindrical membrane retainer and a membrane. The membrane is the active part of this type of valves and it opens or closes the valve depending on the pressure relationship between the two sides of the membrane. The membrane is oiled to ensure that the valve is sealed.

This type of valve is used for coffee packages and packages intended for certain foods. In order to increase the shelf-life of these foods it is important that they be vacuum-packed, i.e. that as much oxygen as possible is evacuated from the packages. In some cases foods are packaged that are also cooked in the same package. During the cooking considerable amounts of water vapour are generated and the excess pressure expels the water vapour. In cooking by means of microwaves, the generation of water vapour is very intense and the flow through the valve is comparatively large. When the above described valves of conventional type are used, the oil is blown off by the water vapour, in many cases resulting in considerable impairment of the sealing capacity of the valve. At best, the valves are still sealed but they have instead become single-use valves. In some cases, it is desirable that foods that are cooked in conjunction with being packaged may be re-heated while still in the same package. In order to avoid having to pierce extra holes in the package it is essential that the valve is serviceable again when the package is re-heated, so as to prevent the package from bursting.

Another problem is the costs. Although these valves are comparatively simple structurally, they still constitute a considerable part of the total costs of the package.

SUMMARY OF THE INVENTION

The object of the present invention therefore is to remove the above problems.

This object is achieved in accordance with the invention in that the one-way valve of the kind defined in the introduction is given the characteristic features appearing from the appended claim 1. Preferred embodiments of the one-way valve appear from the dependent claims.

The inventive one-way valve thus employs an aperture formed in the package material, said aperture being surmounted by an adhesive sheet. The adhesive sheet usually comprises a carrier and an adhesive. The carrier could be made from e.g. plastics or paper and the adhesive could be a glue, the adhesiveness of which diminishes when the glue is exposed to increasing heat. In addition, the adhesive sheet is arranged to uncover the aperture when exposed to pressure loads. One of the advantages gained by this solution is its simplicity and above all the fact that the package itself may be used as part of the valve. The only addition is an adhesive sheet. The adhesive sheet may be opened and closed repeatedly. The valve in accordance with the present invention thus may be used in the course of cooking and packaging of the foodstuff but also during the final re-heating thereof, following which the food is to be removed from the package in order to be served, for instance.

In accordance with one preferred embodiment of the present invention, the package material in which the aperture is formed consists of a laminate with randomly aligned polymer chains. When an aperture is cut out in the package material, a rip easily forms in the laminate, should the latter be of a directional type, i.e. if the polymer chains are orientated in the same direction throughout the entire laminate. The generation of undesirable rips thus is avoided by using a non-directional laminated product.

By forming the aperture as a slit made in the package material and not as a hole it is essentially only package material that will be in contact with the contents of the package. In this manner, the risk that contaminating substances reach the package interior is reduced.

In accordance with another preferred embodiment of the present invention, the slit is designed in such a manner that it constitutes the edges of a tongue formed in the package material. Upon excess pressure inside the package, the tongue thus will bend outwards, away from the package and in this manner, a hole is formed in the package. The slit preferably is V-shaped or in the shape of an arc. A V-shaped slit is easily cut by means of a rectangular cutting punch and an arcuate one by means of a cylindrical cutting punch. The package material intermediate the ends of the slit thus serve as a hinge means about which the tongue bends.

The inventive one-way valve likewise employs a flap formed in the adhesive sheet, which flap essentially covers the tongue formed in the packaging material. The provision of a flap, formed in the adhesive sheet itself, that opens as opposed to of the entire adhesive sheet opening, makes handling easier. If foods are cooked and an undefined part of the adhesive is released to uncover the aperture there is a risk of insufficient sealing during the subsequent vacuum-drawing process. It is an easier task to check that a limited part, such as a flap, adheres to the package than to check that the entire adhesive sheet re-clings each time.

In the inventive one-way valve, the flap aperture and the tongue aperture preferably extend in the same direction. When an excess pressure generates inside the package, said excess pressure will find its path of exit, initially via the tongue and thereafter, in the manner that is most convenient, force the adhesive sheet upwards in the area straight above the tongue. For convenient opening of the flap, the flap aperture thus preferably should extend in the same direction as that of the tongue.

In one embodiment of the valve, the slit is straight/linear. One advantage gained by this configuration is that it reduces the risk that any substances penetrate into the package from the outside, since in principle the aperture is open only when an excess pressure exists inside the package. Another advantage gained by the use of a straight/linear slit is that it has been found that a straight/linear slit together with the adhesive sheet emits a sound signal when the valve opens and an excess pressure exists inside the package. In the final re-heating of the food inside the package, the sound signal indicates that the heating of the food is complete.

A particularly advantageous feature is to position the straight/linear slit beneath the adhesive sheet close to and in parallel with one parameter side thereof. When an excess pressure generates inside the package, the pressure finds the most convenient path of exit, which normally is the shortest one. Conveniently therefore, the slit is positioned in the vicinity of the edge of the adhesive sheet where one wishes the adhesive sheet to be released from the package. The combined features of a slit that is straight/linear and positioned at one edge of the adhesive sheet result in a distinct sound signal upon the generation of an excess pressure inside the package that results in the valve opening. Other combinations are possible in order to produce a sound signal. Combinations where the released part of the adhesive sheet is allowed to vibrate will produce a sound signal.

The adhesive used in the adhesive sheet preferably is of a type that becomes soft when heated and most preferably of a kind that becomes soft upon direct exposure to microwaves and not only indirectly via the contents of the package. The quicker the adhesive softens, the quicker the flap will open upon excess pressure inside the package.

In order to keep the contents as free as possible of toxic and other contaminating substances, the adhesive in direct contact with the slit suitably should be of a kind that is accepted for use in conjunction with foodstuff. The adhesive on the flap for example preferably is of this kind. However, the risk that any matter enters into the package via the slit is minimal.

From cost and handling points of view the adhesive sheet conveniently is configured as a tape. A large number of machines are available on the market today that may be used to attach tapes of the kind referred to above to a package.

Resilient tapes are preferred since they tend to resume their original shape after having been heated. This is a particularly advantageous feature when a straight/linear slit is used in a position adjacent the edge/perimeter of the adhesive sheet, considering that the entire edge/perimeter of the tape will not lift/be released when the valve opens. As a consequence of this fact some tension remains in the tape, resulting in the tape re-closing automatically when the heating stops.

It is likewise possible to use a label as the adhesive sheet. The advantage is that there will be no need for a separate label to be attached to the package. On this label information concerning e.g. contents, product name and product shelf life may be applied.

BRIEF DESCRIPTION OF THE DRAWINGS

The invention will be described in closer detail in the following with reference to the accompanying schematic drawings, which for exemplifying purposes show presently preferred embodiments of the invention.

DETAILED DESCRIPTION OF PREFERRED EMBODIMENTS

Figure 1:
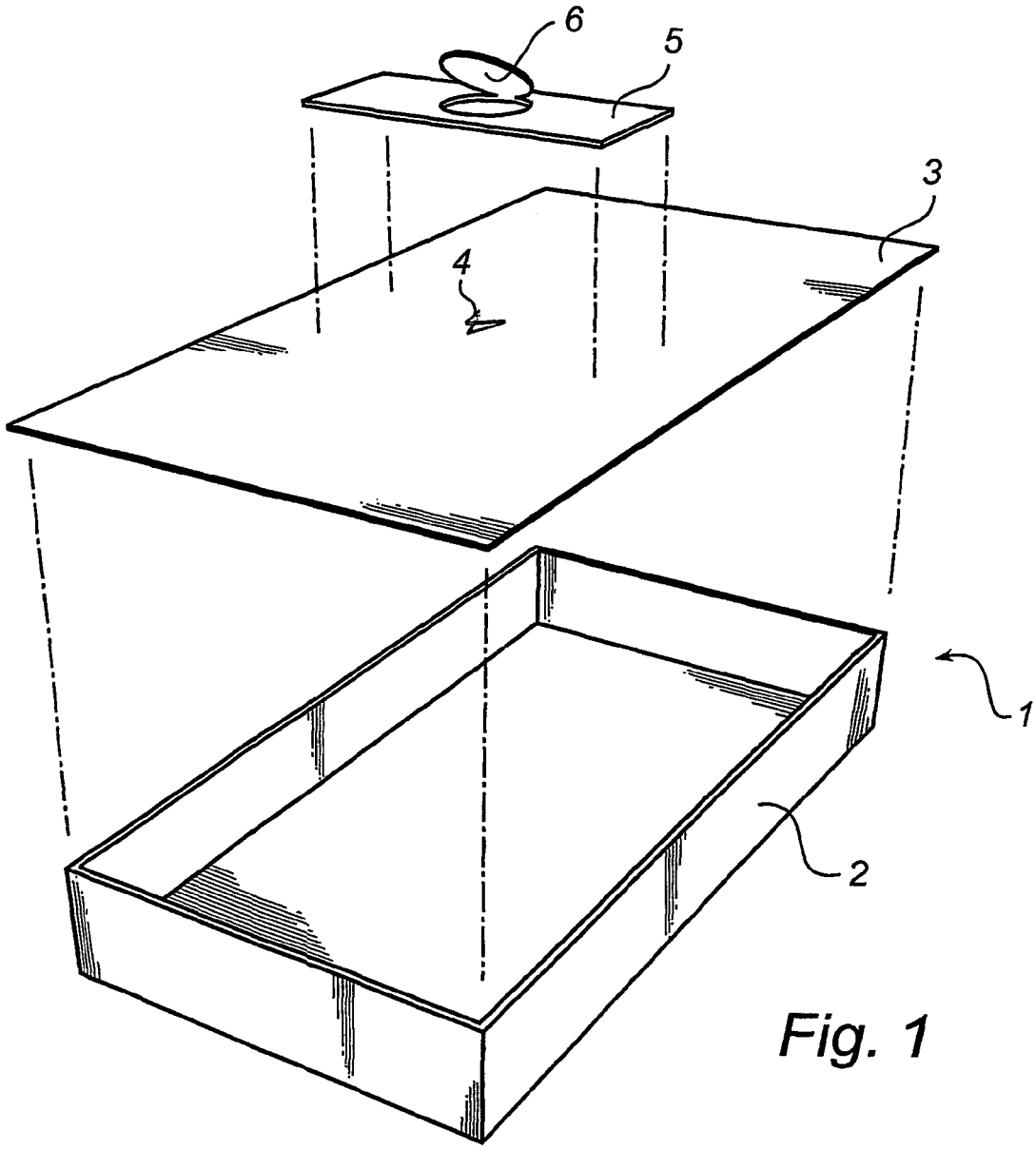
FIG. 1 is an overall view of a package fitted with a valve in accordance with the present invention.

The package 1 shown in FIG. 1 comprises a bottom part 2, a top part 3 formed with a tongue 4, and a tape 5 formed with a flap 6. The tongue 4 is delimited by a V-shaped slit and the flap 6 is arcuate. The bottom part 2 may be made from the same material as the top part 3 or from another stiffer material suitable for use in microwave ovens. The top part 3 is made from a non-directional laminated material in order to prevent the slit that forms the tongue 4 from continuing in the form of a rip in the top part 3. The tape 5 is formed with a flap 6 the aperture of which extends in the same direction as the aperture of tongue 4 in the top part 3.

Figure 2A:
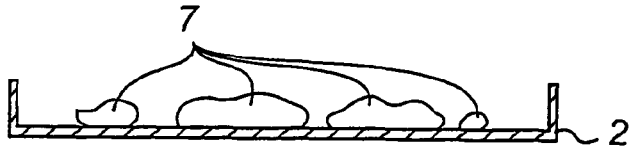
FIGS. 2*a*–2*e* show in sequence views of packaging, cooking and vacuum-sealing food.
Figure 2B:
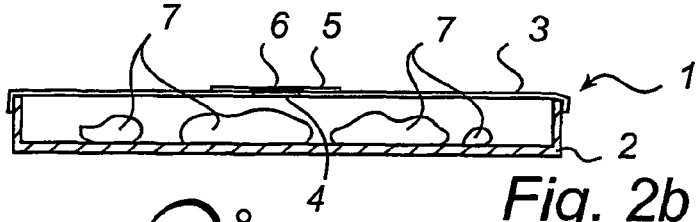
Figure 2C:
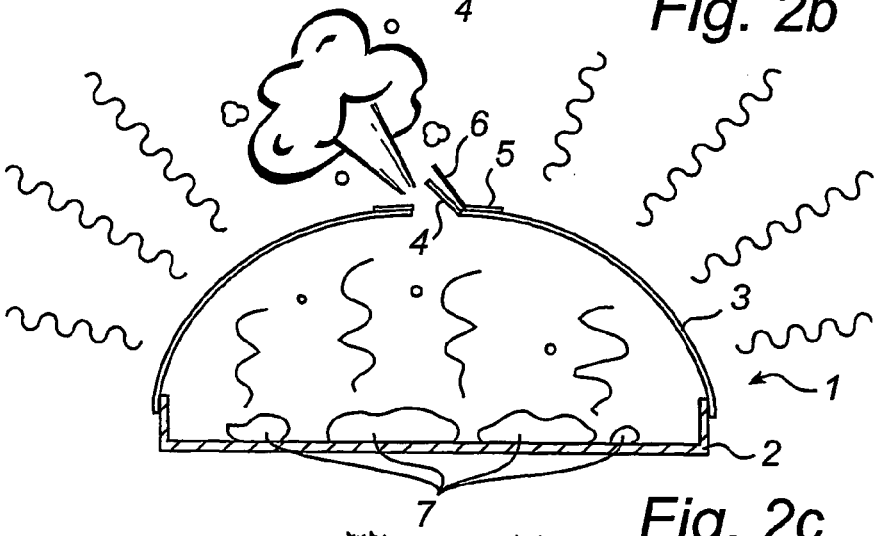
Figure 2D:
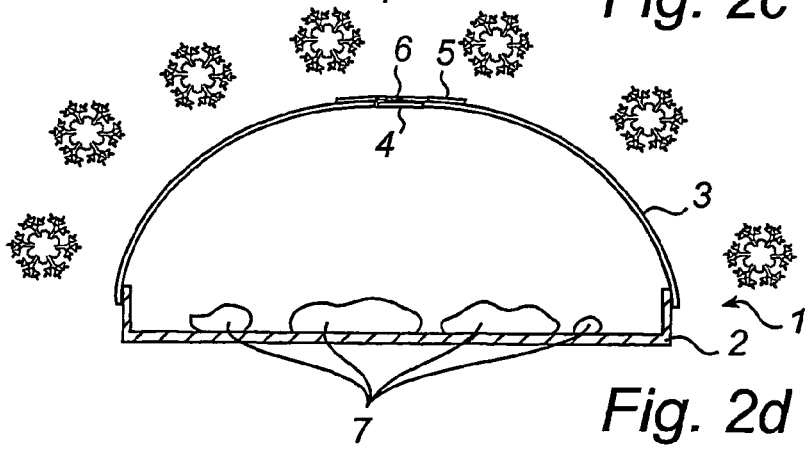
Figure 2E:
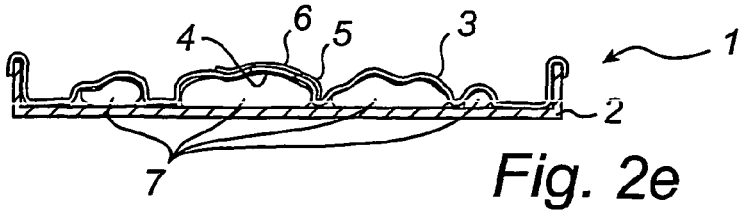

The packaging of the food thus starts by the food 7 being placed on the bottom part 2 of the package 1 as shown in FIG. 2*a*. The top part 3 is placed on the bottom part 2 (FIG. 2*b*), said top part 3 having a tongue formed therein and comprising a tape 5 formed with a flap 6. FIG. 2*c* illustrates how the food 7 inside the package 1 is heated and/or cooked by means of microwaves, in which process the pressure inside the package increases due to vapourisation until the valve opens, i.e. until the tongue 4 and the flap 6 open. During heating, steam mixes with air, thereby vapourising it, and eventually only steam remains in the package. When the heating is finished, the tongue 4 closes and is sealed by the flap 6, and the entire package 1 is cooled (FIG. 2*d*). As the package 1 cools, the condensation of steam causes under-pressure in the package, see FIG. 2*e*, which in combination with the preceding pasteurisation process guarantees a long shelf life of the package contents.

Figure 3:
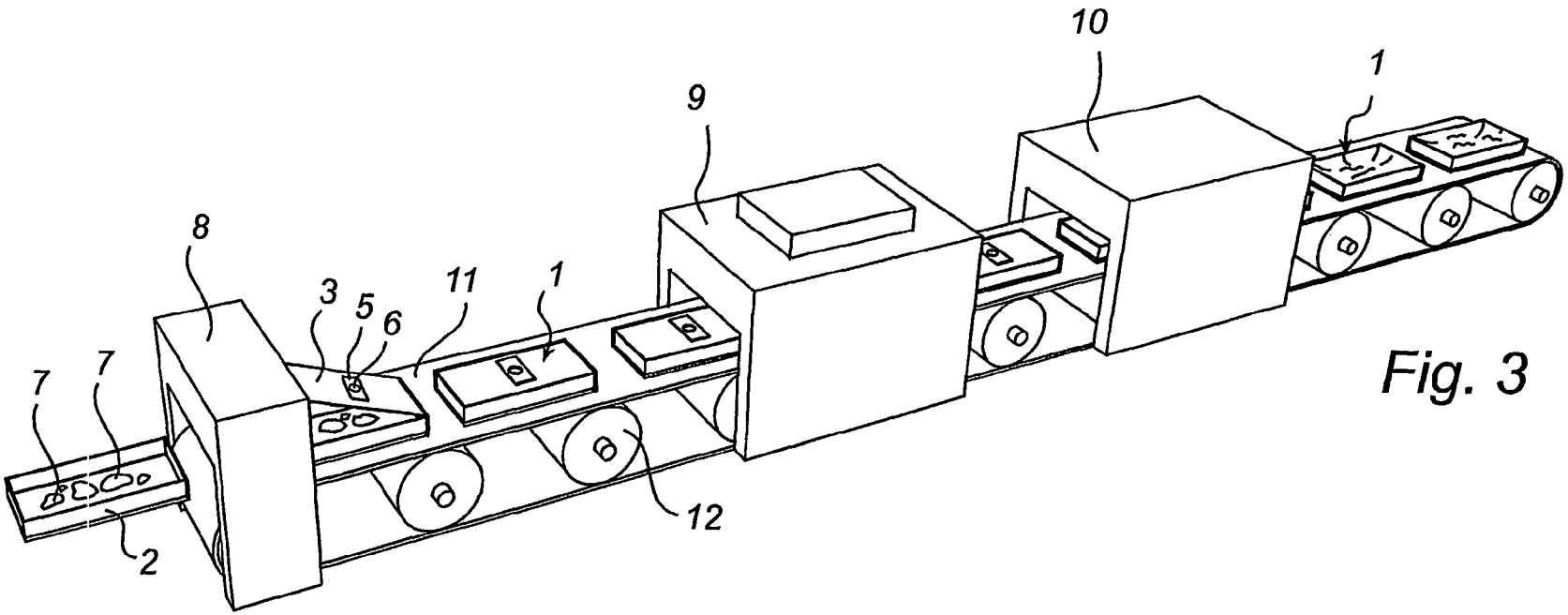
FIG. 3 is a view of a machine designed to package, cook and vacuum-seal food as shown in FIGS. 2*a*–2*e*.

FIG. 3 shows one example of a device for packaging of food 7 in packages 1 fitted with valves in accordance with the present invention. The bottom part 2, preferably made from plastics, with the food 7 thereon is placed on a conveyor belt 11 supported by rollers 12, the latter in turn moving the conveyor belt 11 forwards. In a packaging device 8 the top part 3 is placed on top of the bottom part 2. The top part preferably is made from a transparent laminated material of non-directional plastic. Before the top part 3 is placed on the bottom part 2 a slit is punched in the upper part 3 and a tape 5 having a flap 6 formed therein is glued on top of the slit. The package 1 is advanced further along the belt 11 up to a microwave tunnel 9, in which the food 7 is cooked by heating as illustrated in FIG. 2*c*. When the package leaves the heating zone in the microwave tunnel 9 the valve normally closes automatically. To ensure correct closing of the valve, mechanical means may also be employed, i.e. the flap 6 formed in the tape 5 is pressed against the top part 3 by mechanical means and seals the tongue 4. Following the closing of the valve in the microwave tunnel 9 the cooling process starts and more particularly the cooling is effected in a cooling tunnel 10. In the cooling tunnel 10 the steam inside the packages 1 is condensated due to cooling a certain time, see FIGS. 2*d* and 2*e*. When the packages 1 have passed through the cooling tunnel 10, the food is cooked and packaged. The packages 1 are now ready for transportation and storage.

Figure 4:
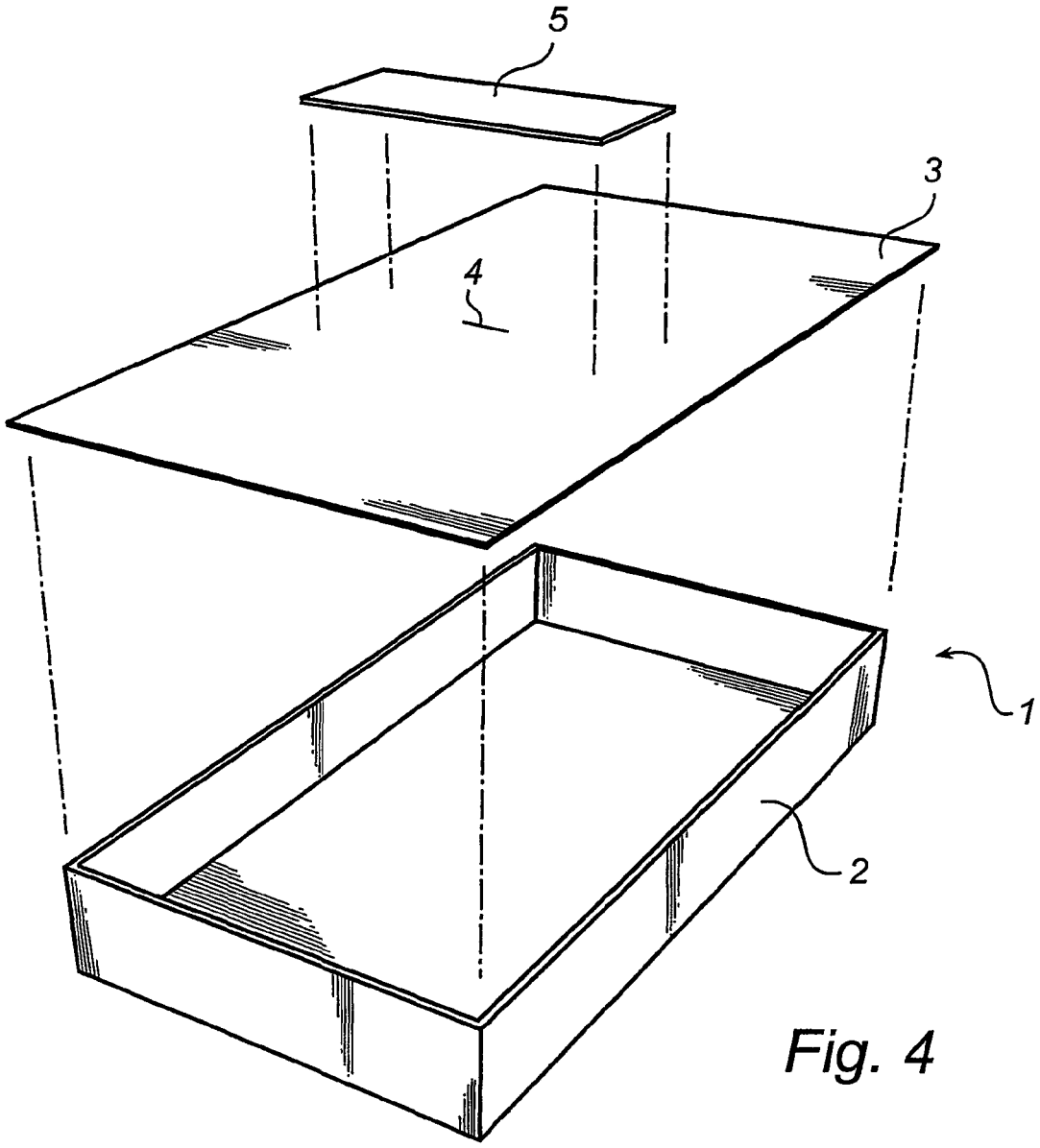
FIG. 4 is an overall view of a package fitted with a valve in accordance with the present invention.

FIG. 4 shows a further embodiment of a package fitted with a valve in accordance with the present invention. In this case, the slit 4 is merely a straight/linear cut. A tape 5 is arranged in a position, wherein one long side of the tape 5 extends in parallel with the slit 4. In accordance with a preferred embodiment, the slit is spaced a distance from one of the two of the tape long sides that is less than half the width of the tape. In this manner, at least the part of the tape 5 located between the slit 4 and the tape edge will be released when the pressure and the heat inside the package 1 increase. When this type of valve opens, a sound signal is generated, which indicates that the heating of the contents inside the package is finished. In accordance with a preferred embodiment of the invention, the tape is resilient. Because the long side of the tape 5 will not be released along its entire length when the valve opens, some tension remains in the tape 5, resulting in the tape automatically re-closing when the heating ceases. This process is based on the condition that the deformation of the tape 5 is not of a plastic nature.

Figure 5:
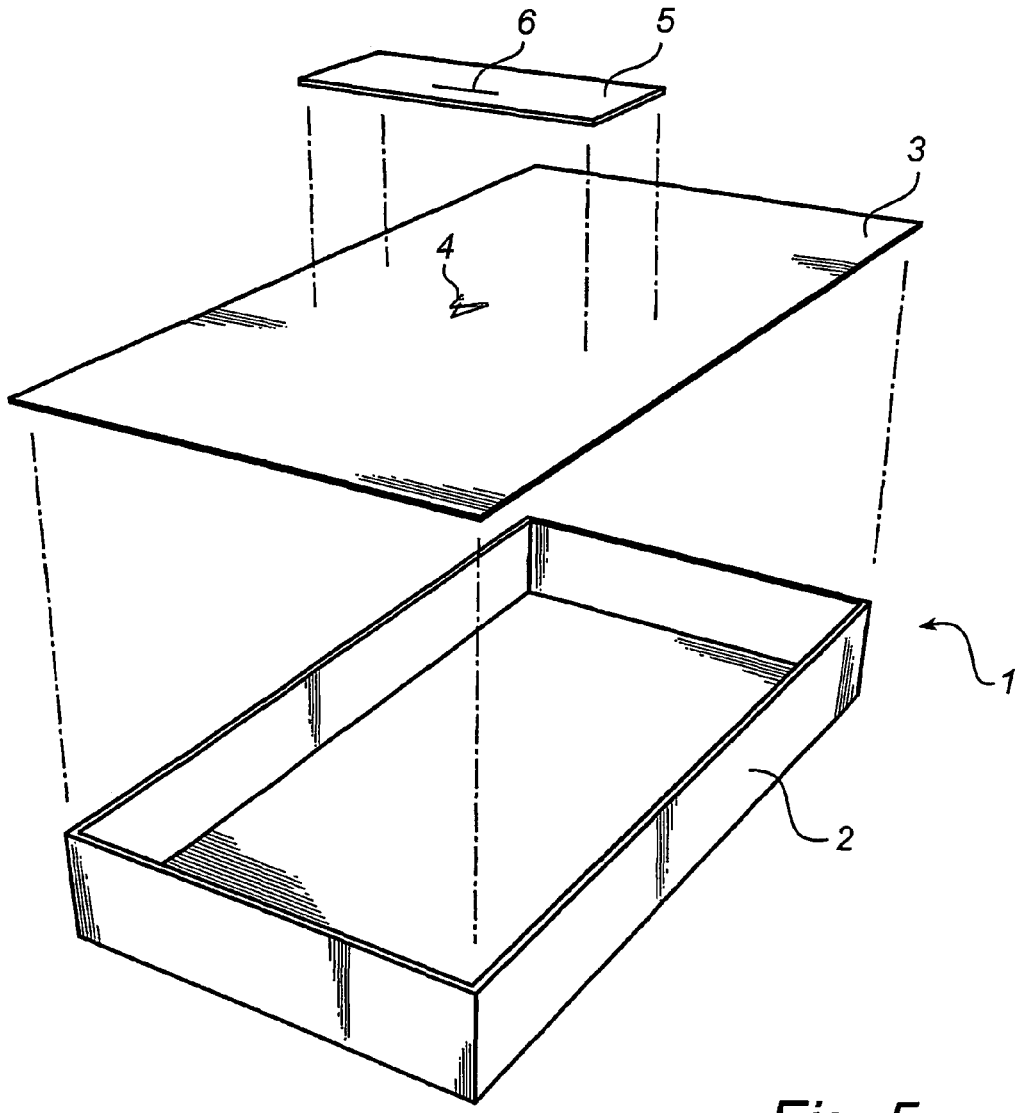
FIG. 5 is an overall view of an alternative embodiment of the package fitted with a valve in accordance with the present invention.

FIG. 5 shows yet another embodiment of the present invention wherein the tape 5 is provided with a straight slit 6. When the valve opens, a defined part of the tape will be released, i.e. the part of the tape 5 between the slit and the part of the tape 5 covering the slit 4. When the valve is open, the edge of the slit 6 that is released will vibrate and produce a sound signal. Due to the slit 6 being linear, since the extension of the slit 6 on both sides of the slit 6 will not be released, the released part of the tape will be forced back to closed position when the heating stops. Thus, automatic closing of the valve is easily achieved.

As will be appreciated, many modifications of the embodiment of the invention described above are possible within the scope of the invention as defined in the appended claims. As described previously, the slit may be made by means of welding, cutting by means of laser or knives. In addition, it is possible to package other substances than foods, such as for example equipment, surgical instruments and the like that need to be sterilised. Likewise, the slit may be configured in various ways, for example be given an undulating shape or the shape of an X. The package fitted with the valve could be a bag, i.e. a package having no separate bottom and top parts. In addition, the adhesive sheet could be formed with folding indications to control the aperture in the adhesive sheet.

The invention claimed is:

1. A one-way valve intended particularly for food packages, said valve designed to be fitted on a package and arranged to open in response to an excess pressure inside said package, said one-way valve being recloseable, and having an aperture formed in the package material, on top of which aperture an adhesive sheet is arranged, said adhesive sheet arranged to uncover the aperture when exposed to pressure loads, and wherein the valve is made recloseable using the adhesive sheet which may be opened and closed repeatedly, the adhesive sheet itself being arranged to emit a sound signal when the valve is open and an excess pressure exists inside the package.

2. The one-way valve as claimed in claim 1, wherein adhesive of the adhesive sheet is arranged to soften when exposed to heat.

3. The one-way valve as claimed in claim 1, wherein the package material in which said aperture is formed is a non-directional laminate.

4. The one-way valve as claimed in claim 1, wherein said aperture is configured as a slit.

5. The one-way valve as claimed in claim 4, wherein the slit is designed to constitute the edges of a tongue formed in the package material.

6. The one-way valve as claimed in claim 4, wherein said slit is V-shaped.

7. The one-way valve as claimed in claim 4, wherein said slit is arcuate.

8. The one-way valve as claimed in claim 1, wherein said adhesive sheet comprises a flap, which essentially covers a tongue formed in the package material.

9. The one-way valve as claimed in claim 8, wherein the direction in which said flap opens essentially is the same as the direction in which said tongue opens.

10. The one-way valve as claimed in claim 4, wherein the slit is linear.

11. The one-way valve as claimed in claim 10, wherein the direction of extension of said slit is parallel with one of the long sides of the adhesive sheet and wherein said slit is located beneath said side of the adhesive sheet.

12. The one-way valve as claimed in claim 1, wherein at least part of the adhesive sheet is provided with an adhesive suitable for use with foods.

13. The one-way valve as claimed in claim 1, wherein said adhesive sheet is a tape.

14. The one-way valve as claimed in claim 13, wherein said tape is resilient.

15. The one-way valve as claimed in claim 1, wherein said adhesive sheet is a label.

* * * * *